US007138192B2

(12) United States Patent
Yamada et al.

(10) Patent No.: US 7,138,192 B2
(45) Date of Patent: Nov. 21, 2006

(54) FILM OF YTTRIA-ALUMINA COMPLEX OXIDE, A METHOD OF PRODUCING THE SAME, A SPRAYED FILM, A CORROSION RESISTANT MEMBER, AND A MEMBER EFFECTIVE FOR REDUCING PARTICLE GENERATION

(75) Inventors: Hirotake Yamada, Anjyo (JP); Tsuneaki Ohashi, Nagoya (JP)

(73) Assignee: NGK Insulators, Ltd., Nagoya (JP)

( * ) Notice: Subject to any disclaimer, the term of this patent is extended or adjusted under 35 U.S.C. 154(b) by 441 days.

(21) Appl. No.: 10/633,906

(22) Filed: Aug. 4, 2003

(65) Prior Publication Data

US 2004/0067392 A1 Apr. 8, 2004

Related U.S. Application Data

(62) Division of application No. 10/197,037, filed on Jul. 17, 2002, now Pat. No. 6,641,941.

(30) Foreign Application Priority Data

Jul. 19, 2001 (JP) ..... P2001-219092
Jun. 21, 2002 (JP) ..... P2002-180769

(51) Int. Cl.
*B32B 9/00* (2006.01)

(52) U.S. Cl. ..... 428/697; 428/699; 428/701; 428/702; 428/323

(58) Field of Classification Search ..... 428/697, 428/699, 701, 702, 323
See application file for complete search history.

(56) References Cited

U.S. PATENT DOCUMENTS 4,911,987 A 3/1990 Sakata et al.
5,008,221 A 4/1991 Ketcham
6,410,471 B1 6/2002 Kaneyoshi
6,641,941 B1 * 11/2003 Yamada et al. ..... 428/702
2001/0003271 A1 * 6/2001 Otsuki ..... 118/723 I
2002/0018921 A1 2/2002 Yamada et al.
2003/0186034 A1 10/2003 Yamada
2003/0232221 A1 12/2003 Yamada et al.

FOREIGN PATENT DOCUMENTS

GB 1 439 947 6/1976
JP 08-290977 A 11/1996

OTHER PUBLICATIONS

Hee Jae Kim: "Plasma-sprayed Alumina-Yttria Ceramic Coating for Cavitation-erosion Protection" Journal Corrosion Sci. Soc. of Korea vol. 18, No. 3, Sep. 1989, pp. 140-146.
C. K. Ullal: "Non-equilibrium Phase Synthesis in $Al_2O_3$ -$Y_2O_3$ by Spray Pyrolysis of Nitrate Precursors" Acta Mater., vol. 49, 2001, pp. 2691-2699.
T. Sugama: "$Y_2O_3$-sealed Ni-Al protective coatings for inconel 625" Surface and Coatings Technology, vol. 106, 1998, pp. 106-116.
U.S. Appl. No. 10/746,353, filed Dec. 24, 2003, Yamada et al.

* cited by examiner

*Primary Examiner*—Ling Xu
(74) *Attorney, Agent, or Firm*—Burr & Brown

(57) ABSTRACT

The invention provides a film of an yttria-alumina complex oxide having a high peel strength with respect to a substrate. A mixed powder of powdery materials of yttria and alumina is sprayed on a substrate to form a sprayed film made of an yttria-alumina complex oxide. Preferably, the powdery material of yttria has a 50 percent mean particle diameter of not smaller than 0.1 μm and not larger than 100 μm, and the powdery material of alumina has a 50 percent mean particle diameter of not smaller than 0.1 μm and not larger than 100 μm. Preferably, the yttria-alumina complex oxide contains at least a garnet phase, and may further contain a perovskite phase.

15 Claims, 1 Drawing Sheet

(a)

(b)

FILM OF YTTRIA-ALUMINA COMPLEX OXIDE, A METHOD OF PRODUCING THE SAME, A SPRAYED FILM, A CORROSION RESISTANT MEMBER, AND A MEMBER EFFECTIVE FOR REDUCING PARTICLE GENERATION

CROSS REFERENCE TO RELATED APPLICATION

This application is a division of U.S. application Ser. No. 10/197,037, filed Jul. 17, 2002, now U.S. Pat. No. 6,641,941, and also claims the benefit of Japanese Patent Application No. P2001-219,092 filed Jul. 19, 2001 and Japanese Application No. P2002-180,769 filed Jun. 21, 2002, the entireties of which are incorporated by reference.

BACKGROUND OF THE INVENTION

The invention relates to a method of producing a film of an yttria-alumina complex oxide, a film of an yttria-alumina complex oxide, a sprayed film, a corrosion-resistant member and a member effective for reducing particle generation.

In semiconductor manufacturing systems requiring a super clean state, halogen-based corrosive gases such as chlorine-based gases and fluorine-based gases are used as deposition gases, etching gases and cleaning gases. For example, these gases are used as cleaning gases for a semiconductor composed of a halogen-based corrosive gas such as $ClF_3$, $NF_3$, $CF_4$, HF and HCl after the deposition stage in a semiconductor producing system, such as a hot CVD system. Further, halogen-based corrosive gases such as $WF_6$, $SiH_2Cl_2$ or the like are used for film formation in the deposition stage.

Further, in film-forming and etching stages of CVD or PVD processes, the chemical reactions for film formation or etching produce by-products, which are deposited onto a susceptor, an electrode or the parts constituting the chamber. Particularly, in a so-called cold wall type system, the chamber wall is low in temperature, so that particles may be easily deposited onto the cold chamber wall. Although such deposits are subjected to wet or dry cleaning processes at predetermined intervals, excessive deposits may fall or be moved onto a semiconductor wafer, resulting in instability of semiconductor processing or reduction of the production yield.

To prevent falling particles, it has been known to apply shot peening or blast treatments using glass beads on the surface of a metal plate to increase the surface roughness, so that the retention force of the metal surface may be improved.

It has been thus desired to form a film that is highly resistive against halogen-based gases or plasmas and which is stable over a long time period on a member used for a semiconductor-producing system, such as a member contained in the chamber or the inner wall surface of the chamber. Further, when by-products are deposited on a member contained in the system or the inner wall surface of the chamber, it is desired that the deposited by-products are retained thereon for a long time period.

The assignee filed a Japanese patent application P2001-110, 136. According to the disclosure, it is possible to form a film of an yttria-alumina complex oxide on a substrate by spraying and to provide a high anti-corrosion property against a halogen-based gas plasma, thus preventing the particle generation. The corrosion-resistant film, however, might leave the following problems. That is, cracks may be induced in the film depending on the conditions for spraying.

The sprayed film may be subjected to a heat treatment at a high temperature. Such heat treatment may induce cracks in the film. If cracks are generated in the film of an article having a substrate and the film, such film may be easily peeled from the substrate to generate particles and reduce the anti-corrosion property against a corrosive substance. The resulting article may be undesirable, thus reducing the production yield.

SUMMARY OF THE INVENTION

An object of the present invention is to provide a film of an yttria-alumina complex oxide having a high peel strength on a substrate.

Another object of the invention is to provide a member effective for reducing particle generation and having a high capability for retaining deposits and that is usable for a long time period with improved stability.

Still another object of the invention is to provide a member effective for reducing particle generation and having a high capability for retaining deposits on the surface, so as to reduce the number of fallen particles due to the deposits on the member and reduce the down time associated with maintenance of a system applying the member.

A first aspect of the invention provides a method of producing a film of an yttria-alumina complex oxide, the method comprising the step of spraying a mixed powder of powdery materials of yttria and alumina onto a substrate to produce a sprayed film composed of an yttria-alumina complex oxide.

Further, the invention provides a film of an yttria-alumina complex oxide obtained by the above method.

Further, the invention provides a film of an yttria-alumina complex oxide, wherein the yttria-alumina complex oxide comprises those of garnet and perovskite phases and a ratio YAL(420)/YAG(420) is not lower than 0.05 and not higher than 1.5, provided that the ratio YAL(420)/YAG(420) is the ratio of a peak strength YAL (420) of the (420) plane of the perovskite phase to a peak strength YAG (420) of the (420) plane of the garnet phase. The peak strengths are measured by X-ray diffraction method.

Further, the invention provides a film formed by spraying, the film being made of an yttria-alumina complex oxide and free from a crack having a length not smaller than 3 μm and a width not smaller than 0.1 μm.

Further, the invention provides a corrosion-resistant member comprising a substrate and a film of an yttria-alumina complex oxide, wherein the yttria-alumina complex oxide comprises those of garnet and perovskite phases and a ratio YAL(420)/YAG(420) is not lower than 0.05 and not higher than 1.5, provided that the ratio YAL(420)/YAG(420) is the ratio of a peak strength YAL (420) of the (420) plane of the perovskite phase to a peak strength YAG (420) of the (420) plane of the garnet phase. The peak strengths are measured by X-ray diffraction method.

The invention further provides a corrosion-resistant member comprising a substrate and a film formed by spraying. The film is made of an yttria-alumina complex oxide and free from a crack having a length not smaller than 3 μm and a width not smaller than 0.1 μm.

Further, a second aspect of the invention provides a member effective for reducing particle generation and comprising a substrate and a surface layer on the substrate. The surface layer has α, calculated according to the following formula, in a range of 50 to 700:

α=(a specific surface area measured by Krypton adsorption method ($cm^2/g$))×(a thickness of the surface layer (cm))×(a bulk density of the surface layer ($g/cm^3$)).

The inventors conceived of spraying a mixed powder of powdery materials of yttria and alumina on a substrate to form a sprayed film of an yttria-alumina complex oxide, and tried the process. Consequently, they have successfully formed a film having a high peel strength on a substrate with improved stability.

The thus obtained film of an yttria-alumina complex oxide does not have substantial cracks and has a high peel strength with respect to the underlying substrate, thereby preventing the peeling of the film and particle generation in contact with a corrosive substance. Additionally, when such a film is subjected to heat treatment, the peel strength of the film with respect to the substrate may be further improved, and cracks not observed in the film after the heat treatment.

Moreover, it is possible to control or regulate the microstructure of the film by controlling the conditions for the spraying process and for the heat treatment. Specifically, a porous film substantially without closed pores, or a porous film having a high ratio of open pores to closed pores may be successfully produced. A member for a semiconductor-producing system may be advantageously produced using such a film and the underlying substrate. Such a member has an improved specific surface area, so that deposits may be firmly held on the surface of the member by an anchor effect to reduce the thickness of the deposits on the member. It is thus possible to produce a film having a specific a value according to the invention of the second aspect, which will be described later in detail.

In a preferred embodiment, the powdery material of yttria has a 50 percent mean particle diameter in a range of 0.1 μm to 100 μm, to further reduce the crack formation and improve the anti-corrosion property against a corrosive substance such as a halogen-based gas.

The powdery material of yttria may preferably has a 50 percent mean particle diameter of not smaller than 0.5 μm, and more preferably not smaller than 3 μm, to further improve the adhesive strength of a film to a substrate. The 50 percent mean particle diameter of the powdery material of yttria is preferably not larger than 80 μm, more preferably not larger than 50 μm and most preferably not larger than 10 μm, to further improve the adhesive strength of the film to the substrate.

In a preferred embodiment, the powdery material of alumina preferably has a 50 percent particle diameter in a range of 0.1 μm to 100 μm. It is thus possible to further reduce the crack formation and to further improve the anti-corrosion property of the film against a corrosive substance such as a halogen based gas.

The 50 percent particle diameter of the powdery material of alumina is preferably not smaller than 0.3 μm and more preferably not smaller than 3 μm, to further improve the adhesive strength of the film to the substrate. The 50 percent mean particle diameter of the powdery material of alumina is preferably not larger than 80 μm, more preferably not larger than 50 μm and most preferably not larger than 10 μm, to further improve the adhesive strength of the film to the substrate.

The 50 percent mean particle diameter (D50) is calculated based on the diameters of primary particles when secondary particles are not observed, and the diameters of secondary particles when the secondary particles are observed, in both of the powdery materials of yttria and alumina.

The mixed ratio of the powdery materials of yttria and alumina is not particularly limited. The ratio (yttria/alumina), however, is preferably 0.2 to 1, and more preferably 0.5 to 0.7, calculated based on the molar ratio of yttria and alumina molecules.

The mixed powder may contain a powdery material of a third component other than yttria powder and alumina powder. It is, however, preferred that the third component does not adversely affect the crystalline phases, such as garnet and perovskite phases, of the yttria-alumina complex oxide, which will be described later. More preferably, the third component is a component capable of replacing the sites of yttria or alumina in the garnet or perovskite phases of an yttria-alumina complex oxide. The third component may preferably be selected from the following: $La_2O_3$, $Pr_2O_3$, $Nd_2O_3$, $Sm_2O_3$, $Eu_2O_3$, $Gd_2O_3$, $Tb_2O_3$, $Dy_2O_3$, $Ho_2O_3$, $Er_2O_3$, $Tm_2O_3$, $Yb_2O_3$, $La_2O_3$, MgO, CaO, SrO, $ZrO_2$, $CeO_2$, $SiO_2$, $Fe_2O_3$ and $B_2O_3$.

When spraying the mixed powder, the mixed powder may be sprayed on a substrate without substantially adding an additive. Alternatively, a binder and a solvent may be added to the mixed powder to produce granules by means of spray drying, and the granules may then be sprayed.

The mixed powder may preferably be sprayed under a low pressure. The pressure is preferably not higher than 100 Torr, to further reduce the pores in the sprayed film and to enhance the corrosion resistance of the resultant film.

In a preferred embodiment, the sprayed film is subjected to a heat treatment, to further improve the peel strength of the film with respect to the substrate.

The film is preferably heat treated at a temperature not lower than 1300° C., and more preferably not lower than 1400° C. It is considered that a layer of a reaction product may be formed along the interface between the substrate and film by increasing the heat treatment temperature to at least 1300° C., so that the peel strength may be improved.

The temperature for the heat treatment has no particular upper limit, so long as the substrate is not degraded or decomposed. The temperature for the heat treatment is preferably not higher than 2000° C., to prevent the degradation of the substrate. When the temperature for the heat treatment of the sprayed film approaches 1800° C., aluminum elements may move and diffuse around the layer of a reaction product once formed along the interface between the film and substrate. Such movement may inversely reduce the peel strength of the corrosion-resistant film. From this point of view, the temperature for the heat treatment is preferably not higher than 1800° C. Further, the temperature is preferably not higher than 1700° C. to prevent crack formation in the film.

This film may be formed continuously over the surface of the substrate. The film, however, may also be formed non-continuously over the entirety of a predetermined face of the substrate. For example, the film may be formed discontinuously on the surface of the substrate. The film may also be formed as a plurality of layer-like islands. In this case, such layer-like islands are not continuous with one another. Alternatively, the film may exist in a dotted manner or in a scattered arrangement on a predetermined surface of the substrate.

In a preferred embodiment, the inventive film is substantially free from cracks. Particularly, the inventive film is free from cracks having a length of not smaller than 3 μm and not smaller than 0.1 μm. The presence of such microcracks may be detected by observing a film using a scanning electron microscope applying a magnification of at least 1000×.

The material of a substrate is not particularly limited. Preferably, the material does not contain elements which might adversely affect the process carried out in a container for plasma generation. From this point of view, the material of a substrate may preferably be aluminum, aluminum nitride, aluminum oxide, a compound of aluminum oxide and yttrium oxide, a solid solution of aluminum oxide and yttrium oxide, zirconium oxide, a compound of zirconium oxide and yttrium oxide, and a solid solution of zirconium oxide and yttrium oxide.

The peel strength of the corrosion-resistant film with respect to the substrate is measured by Sebastians test, assuming that the diameter of the bonded face is 5.2 mm.

The substrate may be porous. The center line average surface roughness Ra of the surface of the substrate is not smaller than 1 μm and more preferably is not smaller than 1.2 μm. It is thus possible to improve the adhesive strength of the film to the underlying substrate and to reduce the particle generation due to the peeling of the film.

The kind of yttria-alumina complex oxide is not particularly limited, and may be selected from the following:

(1) $Y_3AL_5O_{12}$ (YAG: $3Y_2O_3.5Al_2O_3$) This oxide contains yttria and alumina in a molar ratio of 3:5 and has garnet crystalline phase;

(2) $YAlO_3$ (YAL: $Y_2O_3.Al_2O_3$) perovskite crystalline phase; and (3) $Y_4Al_2O_9$ (YAM: $2Y_2O_3.Al_2O_3$) monoclinic system.

In a preferred embodiment, the yttria-alumina complex oxide contains at least a garnet phase. Further in a preferred embodiment, the yttria-alumina complex oxide contains garnet and perovskite phases. It is thereby possible to further improve the peel strength of the film with respect to the substrate and to reduce crack formation.

Particularly preferably, the yttria-alumina complex oxide contains garnet and perovskite phases. A ratio YAL(420)/YAG(420) is not lower than 0.05 and not higher than 1.5. The ratio YAL(420)/YAG(420) is the ratio of a peak strength YAL (420) of the (420) plane of the perovskite phase to a peak strength YAG (420) of the (420) plane of the garnet phase. The peak strengths are measured by X-ray diffraction method.

YAL(420)/YAG(420) is preferably not lower than 0.05, or not higher than 0.5.

The inventive film, or laminate of the film and a substrate, has a superior anti-corrosion property, especially against a halogen-based gas or a plasma of a halogen-based gas.

The corrosion resistant member according to the invention may be used for a system of producing semiconductors such as thermal CVD system to make use of its anti-corrosion property. In a system for producing semiconductors, a semiconductor cleaning gas of a halogen-based corrosive gas is used. The corrosion resistant member according to the invention is corrosion resistant against a plasma of a halogen-based gas, as well as a plasma of a mixed gas of a halogen gas and oxygen gas.

Such halogen gases include $ClF_3$, $NF_3$, $CF_4$, $WF_6$, $Cl_2$, $BCl_3$ or the like.

The second aspect of the invention provides a member effective for reducing particle generation comprising a substrate and a surface layer on the substrate. The layer has a specific surface area per unit area "α" of not lower than 50 and not higher than 700.

When generated by-products and particles deposit on the surface of the member, the deposited by-products and particles may be held in pores of the surface layer, thus preventing the falling or dispersing of the by-products and particles from the surface layer. It is thus possible to reduce semiconductor defects that result from the falling and dispersing of the particles and thereby to reduce the down time of the entire system required for cleaning the deposits on the member.

The specific surface area per unit area "α" is defined according to the following formula:

α=(a specific surface area measured by Krypton adsorption method ($cm^2/g$))×(a thickness of the surface layer (cm))×(a bulk density of the surface layer ($g/cm^3$)).

As can be seen from the above formula, "α" is a kind of index indicating a specific area per unit surface area of a surface layer. The surface area of the surface layer may be calculated, for example, from a design drawing. More specifically, the surface area is calculated on the assumption that the surface is smooth without any irregularities formed on the surface of the layer.

The specific surface area measured by Krypton adsorption method ($cm^2/g$) refers to a specific surface area ($cm^2$) per unit weight (g). That is, the specific surface area refers to the adsorption capacity per unit weight of the surface layer. In other words, that means the amount and diameters of open pores effective for adsorption per unit weight of the surface layer.

On the other hand, the thickness (cm) of the surface layer is multiplied by the bulk density of the surface layer ($g/cm^3$) to obtain a weight per unit surface area of the layer ($g/cm^2$). The weight per unit surface area of the layer ($g/cm^2$) is then multiplied by the specific surface area measured by Krypton adsorption method ($cm^2/g$) to obtain a specific surface area per unit surface area ($cm^2/cm^2$), which is "α". Therefore, "α" is an index indicating the adsorption capacity of a gas, or the amount and diameters of open pores, per unit surface area (1 $cm^2$) of the surface layer. The bulk density is the density calculated by dividing the weight by volume containing open pores and closed pores.

The "α" value has to be controlled to a value not lower than 50 in the present invention. A surface layer having such large specific surface area per unit area "α" is provided on a substrate, according to the present invention, so that the by-products and particles may thereby be adsorbed, adhered or held in the open pores in the surface layer. It is thereby possible to reduce the falling or dispersion of particles from the surface layer. From this point of view, "α" may preferably be not larger than 100.

When "α" is small, the surface area for holding and adsorbing the by-products is insufficient, so that the by-products deposit on the surface layer to form a thicker deposits to increase the deposits fallen from the surface layer, even when the amount of the generated by-product is not increased. Such thicker deposits increase the by-products fallen from the surface layer. Additionally, the surface area exhibits a relatively poor anchor effect, so that the holding capacity of the by-products in the surface layer is reduced.

Besides, even "α" of at least 50 is apparently larger than that of conventional members produced by blasting well known in a shield plate or the like used for a sputtering system (see comparative examples C1, and C2: tables 3 and 4).

When the specific surface area per unit area "α" of the surface layer is made large, the surface area for adsorbing the by-products and particles is also increased. It is therefore speculated that the increased "α" is advantageous for preventing the falling and dispersion of the particles and by-products. Contrary to the speculation, however, it was found that when "α" exceeds 700, the amount of fallen and dispersed particles is increased. The results may be explained as follows. If "α" is beyond 700, the ceramic bone structure constituting the surface layer is fractured microscopically when thermal cycles are applied. Such fractures may contribute to the increase of the particles. From this point of view, "α" is preferably not larger than 500, and more preferably not larger than 300.

The effects, features and advantages of the invention will be appreciated upon reading the following description of the invention when taken in conjunction with the attached drawings, with the understanding that some modifications, variations and changes of the same could be made by the skilled person in the art.

BRIEF DESCRIPTION OF THE DRAWINGS

FIG. 1(*b*) is a cross sectional view schematically showing the member 1 after corrosion.

DETAILED DESCRIPTION OF THE INVENTION

Figure 1:
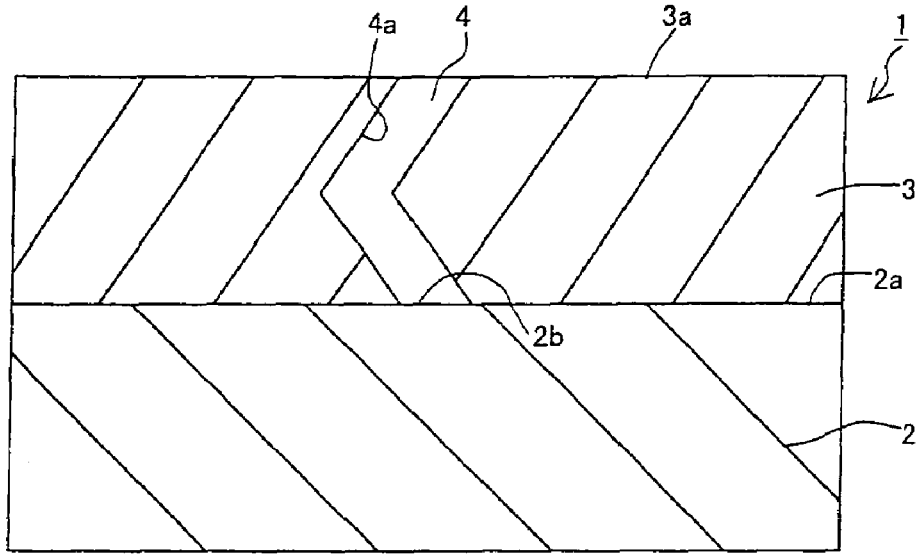
FIG. 1(*a*) is a cross sectional view schematically showing a member effective for reducing particle generation.
Figure 1:
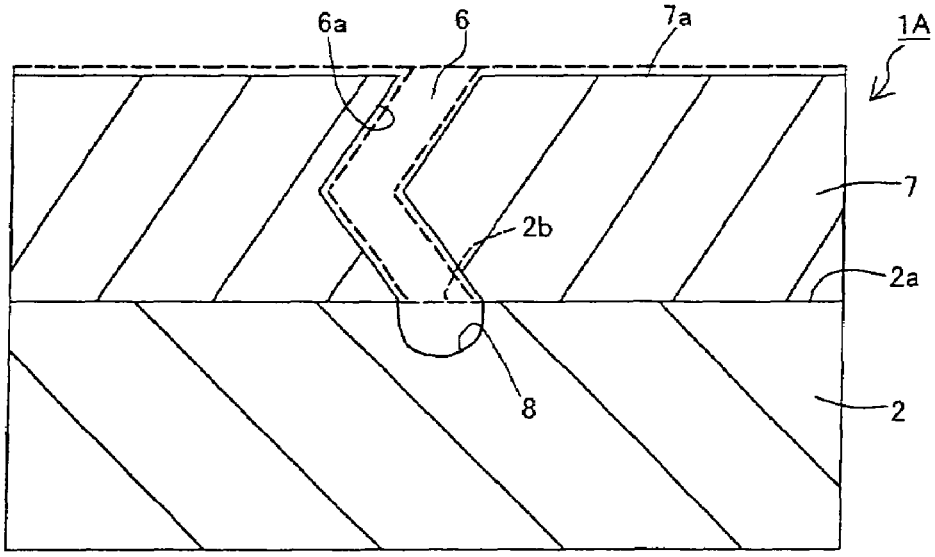

The open porosity of the surface layer is preferably not lower than 10 volume percent, and more preferably not lower than 15 volume percent. It is thus possible to improve the holding capability of the by-products and particles in the surface layer. The open porosity of the surface layer is preferably not higher than 30 volume percent. When the open porosity is higher than 30 volume percent, the corrosion resistance of the surface layer as well as the mechanical strength are reduced. The surface layer itself thus might become a source of generating particles or cracks might be introduced to increase the amount of particles.

The ratio of the open porosity to closed porosity (open porosity/closed porosity) of the surface layer is preferably not lower than 10. Closed pores in the surface layer do not contribute to the retention and adsorption of the by-products and particles, and may accelerate the corrosion of the layer by a corrosive substance. The ratio of the open pores may preferably be higher.

In a preferred embodiment, the pore size of main open pores in the surface layer is in a range of 0.05 to 50 μm. It is thus possible to further improve the retention and adsorption of the by-products and particles in the open pores.

From another point of view, the pore size of the open pores is preferably substantially the same as, or larger than, that according to a design rule applied for producing semiconductor devices. For example, when the design rule of the device to be produced is 0.05 μm, the pore size may preferably be not lower than 0.05 μm.

The reasons will be described below. A wafer with fine grooves formed therein is stored and moved in a $N_2$ atmosphere under an atmospheric pressure. $N_2$ and water content thus adsorb in the fine grooves formed in the wafer. When the wafer is subjected to a subsequent process, such as etching or film-forming, it is necessary to remove $N_2$ and water content adsorbed in the fine grooves of the wafer to secure the process stability. The capacity of a discharge pump and specification of discharged system (diameter of a discharge tube, flow rate of a gas or the like) of a process chamber is usually designed sufficient for removing the gas contents from the fine grooves. The design rule is an index of the width of the fine grooves formed in the wafer. When the open pores in the inventive surface layer of the present invention have a pore size of the same level as the design rule, gas contents in the open pores in the surface layer may be removed using the discharge pump and system. It is therefore considered that the open pores do not adversely affect the stability of the process in the process chamber.

The pore size of the open pores in the inventive film may be substantially same as the design rule. However, the inner wall surface of the chamber usually has a surface area substantially larger than that of a wafer to be treated. When the inner wall surface is made of the inventive film, the surface area of the inventive film is much larger than that of a wafer. In this case, the pore size of the open pores in the inventive film is preferably larger than the design rule.

Further, the thickness of the surface layer is preferably not smaller than 50 μm and more preferably not smaller than 100 μm, for improving the retention and adsorption of the by-products and particles.

On the other hand, the thickness of the surface layer is preferably not larger than 1000 μm and more preferably not larger than 400 μm, to improve the peel strength of the surface layer to the substrate and thus preventing particle generation.

The surface layer may be formed of a material not particularly limited, so long as the material has the corrosion resistance required for the intended use. In a preferred embodiment, the material is selected from the group consisting of an oxide containing a rare earth element, an oxide containing an alkaline earth element, a carbide, a nitride, a fluoride, a chloride, an alloy, a solid solution thereof, and a mixture thereof. The material may more preferably include one or more of the following: cordierite, diamond, silicon nitride, aluminum nitride, magnesium fluoride, calcium fluoride, and aluminum fluoride.

Cordierite is the name of a mineral having a theoretical composition of $2MgO—_2Al_2O_3—5SiO_2$, in which Fe or an alkaline content may be solubilized. Strictly speaking, cordierite is the name of the low-temperature phase of the composition, however its high-temperature phase is also usually called cordierite, which is included in the invention. The surface layer may be composed mainly of cordierite, with another additives and components allowed.

Cordierite contains MgO as its main ingredient and therefore has high corrosion resistance. When talc is used as a source of MgO, talc is liquefied during heat treatment and moved into the grain boundaries of the surrounding particles.

Consequently, spaces once occupied by the talc particles are made empty, leaving open pores. It is therefore possible to control the "α" value in a predetermined range by selecting the particle diameter of the talc particles or the like and conditions for the heat treatment. Talc is the name of a mineral having a theoretical composition of $3MgO.4SiO_2.H_2O$.

A film of diamond may be formed on a substrate mainly by a CVD process. Diamond itself has an automorphic form of a pyramid or a rectangular parallelepiped. It is therefore possible to control the "α" value by selecting the size and shape of the automorphic form. Alternatively, a metal element such as Si may be mixed into a film of diamond, which is then subjected to etching using a fluorine-based plasma such as $NF_3$ to remove only the added metal element to control the "α" value. When applying a film of diamond, it is preferred to use a substrate of silicon nitride, silicon carbide, aluminum nitride, Si, carbon or alumina.

Alternatively, it is possible to form a surface structure of silicon nitride having micro pores. For example, a silicon nitride sintered body is produced using sintering aids of $Y_2O_3$ and $Al_2O_3$. The sintered body is then subjected to heat treatment in a fluorine-based plasma such as $CF_4+O_2$ at a temperature of 100 to 300° C. so that silicon nitride particles are selectively etched. A surface structure having micro pores of $Y_2O_3.Al_2O_3.SiO_2$ series oxide or an oxynitride of Y—Al—Si—N—O series may be thus produced. Alternatively, the silicon nitride sintered body may be subjected to heat treatment in a molted salt of 300° C. composed of KOH:NaOH (1:1, molar ratio) to selectively dissolve the intergranular phases. A surface structure having micro pores mainly composed of silicon nitride may be thus produced.

As described above, the inventive film with the specific pore structure may be formed by spraying as well as by a sol-gel method, PVD, CVD, precipitation reaction from a solution or paste application processes. Alternatively, the surface layer may be subjected to an etching process to form the inventive micro pore structure in the surface region.

In a particularly preferred embodiment, the surface layer is made of a compound containing yttrium. Such a compound may preferably be yttria, a solid solution containing yttria, a complex oxide containing yttria, and yttrium trioxide. Specifically, it may be yttria, a solid solution of zirconia and yttria, a solid solution of a rare earth oxide and yttria, $$3Y_2O_3.5Al_2O_3,\ YF_3,\ Y—Al—(O)—F,\ Y_2Zr_2O_7,\ Y_2O_3.Al_2O_3.Al_2O_3.$$

More preferably, the surface layer is composed of an yttria-alumina complex oxide formed by spraying a mixed powder of powdery materials of yttria and alumina on a substrate. The surface layer may be composed of the complex oxide as described above in the first aspect of the present invention.

That is, in a preferred embodiment, the 50 percent mean particle diameter of the powdery material of yttria is preferably not smaller than 0.1 μm and not larger than 100 μm. The 50 percent mean particle diameter of the powdery material of alumina is preferably not smaller than 0.1 μm and not larger than 100 μm. The film formed by spraying may be subjected to a heat treatment. Further, the yttria-alumina complex oxide preferably contains at least a garnet phase. More preferably, the yttria-alumina complex oxide contains garnet and perovskite phases, and has a ratio YAL (420)/YAG (420) in a range of 0.05 to 1.5. YAL (420) is the peak strength of the perovskite phase and YAG(420) is the peak strength of the garnet phase, and both are measured by an X-ray diffraction analysis.

The member effective for reducing particle generation is to be exposed against a corrosive substance. The corrosive substance includes fluorocarbons such as $CF_4$, $C_3F_6$ or the like, oxygen, chlorine, boron chloride, $CHF_3$, $ClF_3$, $SF_6$, $NF_3$, HBr, $TiCl_4$, $WF_6$, $SiCl_4$, hydrogen, and the mixed gas thereof. The corrosive substance may contain a carrier gas such as He, $N_2$ and Ar.

The corrosive substance may preferably be the halogen gases described above and its plasmas.

In the invention, the material of the substrate may have corrosion resistance lower than that of the material of the surface layer. The reasons will be described below. As shown in FIG. 1(*a*), a member 1 effective for reducing particle generation has a substrate 2 and a surface layer 3 formed on the surface 2*a* of the substrate 2. An open pore 4 communicates from the surface 3*a* of the surface layer 3 to the surface 2*a* of the substrate 2. 4*a* is an inner wall face of the open pore, and 2*b* is an exposed face of the substrate 2 facing the open pore. The open pore 4 has a small pore size as described above and the layer 3 has some thickness. The open pore thus has an elongate shape of a relatively large aspect ratio.

When the member 1 is contacted with a corrosive substance, the surface layer 3 is corroded as shown in a solid line shown in FIG. 1(*b*). Dotted lines indicate the outline of the surface layer 3 before the corrosion. The surface 7*a* of the surface layer 7 is corroded, as well as the inner wall surface 6*a* of the open pore 6 and the exposed face 2*b* of the substrate 2. When the etching rate of the substrate 2 is larger than that of the surface layer 7 (susceptible to a corrosive substance), a relatively large hole 8 is formed on the exposed face 2*b* of the substrate 2. The etched hole 8 communicates with the open pore 6. On the other hand, the etching rate of the inner wall face 6*a* of the open pore 6 is relatively small, so that the pore size of the open pore 6 is relatively unchanged after the corrosion. Consequently, the aspect ratio of the open pore 6 (including 8) is not largely changed, or may even become larger, after the corrosion (the open pore is made elongated).

The substrate 2 is more susceptible to a corrosive substance in this case. Therefore, such an elongate open pore with a relatively large aspect ratio is advantageous for preventing the contact of the substrate and a corrosive substance and for preventing particle generation from the substrate.

The material from which the substrate may be composed of is not particularly limited. Preferably, the material does not contain elements which might adversely affect the process carried out in a container for plasma generation. From this point of view, the material of the substrate is preferably aluminum, aluminum nitride, aluminum oxide, a compound of aluminum oxide and yttrium oxide, a solid solution of aluminum oxide and yttrium oxide, zirconium oxide, a compound of zirconium oxide and yttrium oxide, and a solid solution of zirconium oxide and yttrium oxide. In a particularly preferred embodiment, the substrate is composed of alumina, spinel, an yttria-alumina complex oxide, zirconia or a complex oxide thereof.

In a preferred embodiment, a compression force is applied onto the surface layer after forming the layer. The application of the force is effective for preventing particle generation from the surface layer. The compression force may be applied by heat treatment.

The method for controlling the "α" value (specific surface area per unit area of a surface layer) is not particularly limited. Preferably, a mixed powder of powdery materials of yttria and alumina is sprayed onto a substrate to from a sprayed film, which is then subjected to heat treatment, as described above. The powdery materials react with each other during the spraying step so that the volume is changed. Such volume changes introduce many pores in the film. During the heat treatment of the sprayed film with many pores, the crystalline phase transformation further proceeds so that the film shrinks to increase the open porosity and "α" value. Such a phenomenon was discovered by the present inventors.

Alternatively, the "α" value may be controlled by etching using an acidic solution or plasma, particularly by etching by means of selective corrosion. The "α" value may also be controlled by recent mechanical machining processes.

EXAMPLES (Experiment A)

Powdery materials each having a mean particle diameter (50 percent mean particle diameter) as shown in table 1 were prepared. Yttria particles (examples A1 to A3) with a mean particle diameter of 0.1, 0.5, or 5 μm were measured based on primary particles. The diameters of the other yttria particles (examples A4 to A8) were measured based on secondary particles. Alumina particles (examples A1 to A4) with a mean particle diameter of 0.1, 0.3, 4 and 20 μm were measured based on the primary particles and the other alumina particles (A5 to A8) are measured based on secondary particles.

In the examples A1 to A8 shown in table 1, powdery materials of yttria and alumina were mixed in a ratio of 57.1:42.9 based on weight. The molar ratio of yttria and alumina was 3:5. In the examples A1 to A3, powdery materials of yttria and alumina were wet mixed using a ball mill and granulated using a spray drier to obtain granules having a mean particle diameter of 40 μm. In the examples A4 to A8, powdery materials of yttria and alumina were dry mixed.

A plate-shaped substrate made of alumina (with a purity of 99.7 percent) having a length of 50 mm, a width of 50 mm and a thickness of 2 mm was prepared. The above mixed powder was plasma sprayed on the substrate using a plasma spraying system supplied by SULZER METCO. During the spraying, argon was supplied in a flow rate of 40 liter per minute and hydrogen was supplied in a flow rate of 12 liter per minute. The power for the spraying was 40 kW, and spray distance was 120 mm.

In the example A9, only the powder of yttria-alumina garnet (having a mean particle diameter of 40 μm was plasma sprayed on the substrate under the conditions described above. The thus obtained films of the examples were subjected to the following measurements.

(Identification of Crystalline Phases)

The crystalline phases in each film were identified using an X-ray diffraction system, according to the conditions below. The YAL(420)/YAG(420) ratio was then calculated:

CuKα, 50kV, 300 mA, 2θ=20 to 70°;

Applied system: Rotating anode type X-ray diffraction system "RINT" supplied by "Rigaku Denki."

(Peel Strength)

The peel strength was measured according to the following method:

1. A film-formed sample (laminate) was cut into a small test piece with a length of 10 mm, width of 10 mm and thickness of 2 mm (including the thickness of the film);
2. The cut piece was ultrasonically cleaned with acetone for 5 minutes;
3. An adhesive-provided A1 stud pin (manufactured by Phototechnica Co., Ltd.) was prepared. This bonding area had a circle shape of 5.2 mm in diameter;
4. The pin was bonded to the film-formed side of the piece; and
5. The pin bonded to the piece was fitted to a jig, and pulled up by an "AUTOGRAPH," manufactured by Shimadzu Co., Ltd., until the film was peeled.

The bonding strength was calculated from the bonding area and the load when the film was peeled (Peel strength=peeling load/bonding area of the pin). When the peeling occurred in the adhesive, the peeling load value was not used as a result of the measurement.

(Observation of Cracks)

The surface of each film was observed using a scanning electron microscope in a magnification of 5000×.

(Corrosion Resistant Test)

The sample of each example was set in a corrosion test system for performing the test under the following conditions. Each sample was held in $Cl_2$ gas (heater off) for 2 hours. The flow rate of $Cl_2$ gas was 300 sccm and that of the carrier gas (argon gas) was 100 sccm. The gas pressure was set at 0.1 Torr, and a power of RF 800W and a bias voltage of 310 W was applied. The weights of each sample before and after the exposure to $Cl_2$ gas were measured and the weight change was calculated.

TABLE 1

| | Mean particle diameter of $Y_2O_3$ powder (μm) | Mean particle diameter of $Al_2O_3$ (μm) | Ratio of peak strength YAL(420)/ YAG(420 | Peel strength MPa | Presence of Cracks | Weight Gain after Corrosion test mg/hr | |
|---|---|---|---|---|---|---|---|
| A1 | 0.1 | 0.1 | 0.000 | 8 | None | 0.0 | |
| A2 | 0.5 | 0.3 | 0.597 | 12 | None | 0.0 | |
| A3 | 5 | 4 | 0.324 | 30 | None | 0.0 | |
| A4 | 20 | 20 | 0.203 | 10 | None | 0.0 | |
| A5 | 50 | 50 | 0.108 | 12 | None | 0.1 | |
| A6 | 80 | 80 | 0.07 | 11 | None | 0.1 | |
| A7 | 100 | 100 | 0.05 | 10 | None | 0.1 | |
| A8 | 120 | 120 | | 13 | None | 0.7 | YAM phase observed |
| A9 | YAG powder only (40 μm) | | 0.00 | 3 | Present | 1.2 | |

As can be seen from Table 1, in the example A9, powder of yttria-alumina garnet was sprayed on the substrate and a perovskite phase was not observed in the resultant sprayed film. The peel strength of the film was relatively low and cracks were observed. The weight gain after the corrosion test was also large. In the examples A1 to A8, the mixed powder was sprayed. The peel strength was relatively large and cracks were not observed. In particular, when the mean particle diameter of the yttria powder was 0.5 to 100 μm and that of the alumina powder was 0.3 to 100 μm, the peel strength was not lower than 10 MPa, cracks were not observed and the corrosion resistance was considerably higher. In A8, the mean particle diameters of powdery materials of yttria and alumina were 120 μm, respectively, with a YAM phase formed. In A8, the peel strength was as high as 13 MPa with the corrosion resistance slightly reduced.

(Experiment B)

The samples covered with the films of the examples A1 to A9 were subjected to heat treatment, respectively, at 1500° C. for 3 hours. The thus obtained films were evaluated as the experiment A and the results were shown in Table 2.

TABLE 2

| | Mean particle Diameter of Y2O3 (μm) | Mean particle Diameter of Al2O3 (μm) | Temperature of heat treatment (° C.) | Ratio of Peak strength YAL(420)/ YAG(420) | Peel strength MPa | Presence Of Cracks | Weight gain After Corrosion test mg/hr |
|---|---|---|---|---|---|---|---|
| B1 | 0.1 | 0.1 | 1500 | 0.000 | 3 | Present | 0.7 |
| B2 | 0.5 | 0.3 | 1500 | 0.206 | 43 | None | 0.0 |
| B3 | 5 | 4 | 1500 | 0.258 | 48 | None | 0.0 |
| B4 | 20 | 20 | 1500 | 0.653 | 52 | None | 0.0 |
| B5 | 50 | 50 | 1500 | 0.996 | 45 | None | 0.1 |
| B6 | 80 | 80 | 1500 | 1.257 | 48 | None | 0.1 |
| B7 | 100 | 100 | 1500 | 1.385 | 45 | None | 0.1 |
| B8 | 120 | 120 | 1500 | 1.516 | 40 | None | 0.8 |
| B9 | YAG powder only (40 μm) | | 1500 | 0.00 | 3 | Present | 1.0 |

As can be seen from Table 2, in the example B9, perovskite phase was not observed in the film. The peel strength was relatively small, cracks were not found and the weight gain was large after the corrosion test. In the examples A1 to A8, the mixed powder was sprayed and the peel strength was relatively large. In the example B1, however, a reduction of the peel strength and crack formation was observed. In particular, when the particle diameter of yttria powder was 0.5 to 100 μm and the particle diameter of alumina powder was 0.3 to 100 μm, the peel strength was considerably improved to a value over 40 MPa and cracks were not observed.

In the examples B4 to B8, the peak strength of YAL phase was considerably improved after the heat treatment. The tendency was considerable in the examples B6, B7 and B8. In the example A8, the ratio of peak strengths YAL(420)/YAG(420) was higher than 1.5, cracks were not observed and the peel strength not considerably reduced. However, the weight gain after the corrosion test was larger. This is due to the difference of the crystalline phases constituting the films.

As described above, the invention may provide an yttria-alumina complex oxide film with a high peel strength of the film to a substrate.

(Experiment C)

The members of examples C1 to C16 shown in Tables 3 and 4 were produced. In the example C1, a dense alumina sintered body was finished by blasting using #80 abrasive grains and machined to a thickness of about 400 μm to obtain a self-standing test sample. In C2 and C3, YAG powder with a mean particle diameter of 40 μm was sintered at 1600° C. or 1500° C. to produce each sintered body. Each sintered body was then finished by blasting using #80 abrasive grains and machined to a thickness of about 400 μm to obtain a self-standing test sample.

In each of the examples C4 to C16, a sprayed film was formed as described in the experiment A on each of two substrates. The substrate has a length of 150 mm, width of 150 mm and thickness of 5 mm. The thus obtained sprayed film was subjected to a heat treatment in the examples C4 and C8 to C16. The ratio of the peak strengths, peel strength, the presence of cracks, results of corrosion resistant test, porosity, specific surface area measured by krypton adsorption method ($cm^2/g$), average thickness of the film, a, volume measured by mercury penetration method, pore size and number of particles were measured for each sample.

(α)

The specific surface area was measured by a Kr gas adsorption multipoint BET method. The bulk density of the surface layer was set at 4 $g/cm^3$.

(Volume Measured by Mercury Penetration Method; Pore Size)

A porosimeter (mercury penetration system) was used for measuring the range of pore size of 1 nm to 200 μm. The pore size had a relatively broad distribution. Therefore, each range of the pore size including main peaks is shown in table 4. The surface tension value of mercury applied was 485 $erg/cm^2$ and a contact angle of 130° was applied.

(Porosity)

Porosity was measured using the Archimedian method. In the examples C7 to C16, it was confirmed that pores in the film were substantially composed of open pores, judging from the ratio of the bulk density and the apparent density measured by Archimedian method.

(Number of Particles)

35 g of alumina powder used in the comparative example C1 was suspended in pure water in an amount of 100 to 1000 cc. Each of the samples of the examples C1 to C16 was immersed in the suspension and dried in the atmosphere at 120° C. The process was repeated until the suspended state disappeared, so that almost all of the alumina particles were deposited onto the coated surface layer of the test sample. Fifty thermal cycles between room temperature and 200° C. were applied on the sample while holding the sample with its coated surface layer directed downwardly. After the thermal cycles, the number of particles that fell on an Si wafer set under the sample were counted.

TABLE 3

| | | Production | Mean particle Diameter of Y2O3 powder (μm) | Mean particle diameter of Al2O3 (μm) | Temperature Of heat Treatment (° C.) | Ratio of peak strength YAL(420)/ YAG(420) | Peel strength (MPa) | Presence of Cracks |
|---|---|---|---|---|---|---|---|---|
| C1 | Comparative example | Sintered alumina Blast finishing | — | 20 | Sintered at 1600° C. | 0 | — | None |
| C2 | Comparative Example | Sintered alumina Blast finishing | YAG powder only (40 μm) | | Sintered at 1600° C. | 0 | — | None |
| C3 | Comparative Example | Sintered YAG | YAG powder only (40 μm) | | Sintered at 1500° C. | 0 | — | None |
| C4 | Comparative Example | Spraying of YAG synthesized Powder | YAG powder only (40 μm) | | 1600 ° C. | 0 | 4 | Present |
| C5 | Example | Spraying of mixed powder | 20 | 20 | No heat Treatment | 0.243 | 10 | None |
| C6 | Example | Same as above | 20 | 20 | No heat Treatment | 0.210 | 10 | None |
| C7 | Example | Same as above | 20 | 20 | No heat Treatment | 0.195 | 11 | None |
| C8 | Example | Same as above | 20 | 20 | 1400 | 0.597 | 23 | None |
| C9 | Example | Same as above | 20 | 20 | 1400 | 0.541 | 19 | None |
| C10 | Example | Same as above | 20 | 20 | 1400 | 0.553 | 30 | None |
| C11 | Example | Same as above | 20 | 20 | 1600 | 0.803 | 52 | None |
| C12 | Example | Same as above | 20 | 20 | 1600 | 0.784 | 57 | None |
| C13 | Example | Same as above | 20 | 20 | 1600 | 0.792 | 53 | None |
| C14 | Example | Same as above | 50 | 50 | 1600 | 0.732 | 60 | None |
| C15 | Example | Same as above | 50 | 50 | 1600 | 0.718 | 62 | None |
| C16 | Example | Same as above | 50 | 50 | 1600 | 0.696 | 67 | None |

TABLE 4

| | | Weight gain after Corrosion test mg/hr | Porosity % | Kr method cm2/g | Average Thickness (μm) | Ratio of Specific surface area α | Volume by Mercury Penetration cc/g | Range of Pore size (μm) | Number of Particles |
|---|---|---|---|---|---|---|---|---|---|
| C1 | Comparative Example | 4.7 | <1 | 28 | 400 | 4 | 0.0064 | — | Many |
| C2 | Comparative Example | 0.0 | <1 | 9 | 400 | 1 | 0.0071 | — | Many |
| C3 | Comparative Example | 1.3 | 10 | 9,317 | 400 | 1,491 | 0.0302 | 0.08–2.5 | Many |
| C4 | Comparative Example | 1.0 | 4 | 710 | 60 | 17 | 0.0147 | 0.004–4 | Many |
| C5 | Example | 0.0 | 5 | 1,173 | 123 | 58 | 0.0062 | 0.05–8 | 200 |
| C6 | Example | 0.0 | 6 | 1,191 | 212 | 101 | 0.0070 | 0.05–8 | 50 |
| C7 | Example | 0.0 | 5 | 1,157 | 430 | 199 | 0.0063 | 0.05–8 | 50 |
| C8 | Example | 0.0 | 11 | 1,256 | 99 | 50 | 0.0111 | 0.05–8 | 0 |
| C9 | Example | 0.0 | 13 | 1,192 | 196 | 93 | 0.0131 | 0.05–8 | 0 |
| C10 | Example | 0.0 | 13 | 1,183 | 408 | 193 | 0.0128 | 0.05–8 | 0 |
| C11 | Example | 0.0 | 18 | 1,333 | 110 | 59 | 0.0379 | 0.05–14 | 0 |
| C12 | Example | 0.0 | 17 | 1,304 | 194 | 101 | 0.0390 | 0.05–14 | 0 |
| C13 | Example | 0.0 | 18 | 1,298 | 417 | 217 | 0.0401 | 0.05–14 | 0 |
| C14 | Example | 0.0 | 17 | 1,382 | 111 | 61 | 0.0443 | 0.2–20 | 0 |
| C15 | Example | 0.0 | 16 | 1,370 | 220 | 121 | 0.0452 | 0.2–20 | 0 |
| C16 | Example | 0.0 | 16 | 1,404 | 406 | 228 | 0.0493 | 0.2–20 | 0 |

The samples of C1 and C2 were dense sintered bodies and did not have capacity to hold particles on the surfaces. Thus, many particles fell on the wafer from the sintered bodies. In C3, "α" was considerably increased because of insufficient sintering of YAG. Such insufficient sintering results in many fine open pores. In this case, even more particles fell after the thermal cycle. In C4, "α" of the surface layer was small and many particles fell. "Many particles" means approximately more than 10,000 per one wafer. In C5 to C16 according to the invention, the number of particles that fell on the wafer was considerably reduced. Particularly, samples of C8 to C16 were found to be superior. It is considered that each of the samples of C8 to C16 have higher a porosity than those of C5 to C7. C1 to C16 had superior peel strength.

Among the inventive examples, a mixed powder of powdery materials of yttria and alumina were sprayed to produce a sprayed film in C5 to C16. In the samples in C5, C6 and C7, the sprayed film was not subjected to heat treatment and the porosity was lower than 10 percent. In samples C8 to C16, the porosity of the film was increased to a value higher than 10 percent as a result of a heat treatment.

Moreover, in the samples of C5 to C16, the ratio of peak strengths were in a range of 0.05 to 1.5, the peel strength was therefore large, and cracks were not observed.

Example C17

Talc with a particle diameter of 10 μm, fused quartz and alumina powder with a particle diameter of 25 μm were mixed with methyl cellulose and water and kneaded to produce a paste, which was then applied on an alumina substrate having a length of 150 mm, width of 150 mm and thickness of 5 mm, as in the examples C4 to C16. The substrate was then subjected to heat treatment in an atmosphere at 1400° C. The steps of applying the paste and the subsequent heat treatment were repeated several times to form a cordierite layer having an average thickness of 120 μm. A bulk density of 2.0 g/cm2 was used for calculating the "α" value.

The peel strength of the film was 36 MPa without cracks observed. The weight gain after the corrosion resistant test was −0.3 mg/hour, the porosity was 21 percent, average thickness was 120 μm, "α" was 139, volume measured by mercury penetration method was 0.102 cc/g, the rage of pore size was 1 to 40 μm and number of particles was 0.

Example C18

A diamond film was formed on a substrate made of silicon nitride. The substrate was produced by mixing a type silicon nitride powder having a particle diameter of about 1 μm, 5 mol percent of $Y_2O_3$, 2 mol percent of $Al_2O_3$, and 5 mol percent of β type silicon nitride and subjecting the mixture to a heat treatment in nitrogen atmosphere at 1850° C. to obtain a densified body. The substrate had the same shape and dimensions as those in the example 17. A film of diamond with a thickness of about 50 μm was produced on the substrate by a microwave CVD process. Quartz glass was set around the substrate to add Si and oxygen into the diamond film. The substrate was then exposed to a down flow plasma of a mixed gas of $NF_3$ and Ar for 10 hours, while maintaining the temperature of the substrate in a range from 150 to 300° C., so that a micro pore structure could be formed. A bulk density of 3.2 g/cm$^3$ was used for calculating the "α" value.

The peel strength of the film was 54 MPa and cracks were not observed. The weight gain after the corrosion resistant test was 0.0 mg/hour, the porosity was 10 percent, the average thickness was 50 μm, a was 53, and the number of fallen particles was 0.

As described above, the present invention provides a member having a high capability for holding deposits firmly on the surface, so that fallen particles due to the surface deposits may be reduced.

The present invention has been explained referring to the preferred embodiments. The invention is, however, not limited to the illustrated embodiments which are given by way of examples only, and may be carried out in various modes without departing from the scope of the invention.

The invention claimed is:

1. A member effective for reducing particle generation and comprising a substrate and a surface layer on said substrate, wherein said surface layer comprises a yttria-alumina complex oxide having an α value in a range of 50 to 700 calculated according to the following formula, wherein α=(a specific surface area measured by Krypton adsorption method (cm$^2$/g))×(a thickness of said surface layer (cm))×(a bulk density of said surface layer (g/cm$^3$)); and wherein said surface layer has an open porosity of at least 11 volume percent.

2. The member of claim 1, wherein the open porosity of said surface layer is not higher than 30 volume percent.

3. The member of claim 1, wherein a ratio of the open porosity to a closed porosity (open porosity/closed porosity) of said surface layer is not higher than 10.

4. The member of claim 1, wherein a pore diameter of main open pores of said surface layer is in a range of 0.05 to 50 μm.

5. The member of claim 1, wherein said surface layer has a thickness of at least 50 μm.

6. The member of claim 1, wherein said surface layer further comprises a material selected from the group consisting of an oxide containing a rare earth element, an oxide containing an alkaline earth element, a carbide, a nitride, a fluoride, a chloride, an alloy, a solid solution thereof and a mixture thereof.

7. The member of claim 1, wherein when said member is exposed to a corrosive substance, a material constituting said substrate has an etching rate against said corrosive substance that is larger than that of a material constituting said surface layer.

8. The member of claim 7, wherein said corrosive substance is a halogen gas or a plasma of a halogen gas.

9. The member of claim 1, wherein said substrate is made of a material selected from the group consisting of alumina, spinel, yttria, zirconia and the complex oxide thereof.

10. The member of claim 1, wherein said surface layer is a film formed by spraying a mixed powder of powdery materials of yttria and alumina an said substrate.

11. The member of claim 10, wherein 50 percent mean particle diameter of said powdery material of yttria is in a range of 0.1 μm to 100 μm.

12. The member of claim 10, wherein said a 50 percent mean particle diameter of said powdery material of alumina is in a range of 0.1 μm to 100 μm.

13. The member of claim 10, wherein said film is thermally treated.

14. The member of claim 10, wherein said yttria-alumina complex oxide includes at least garnet phase.

15. The member of claim 14, wherein said yttria-alumina complex oxide comprises garnet and perovskite phases, and wherein a YAL(420)/YAG(420) ratio is in a range of 0.05 to 1.5, provided that said YAL(420)/YAG(420) ratio is the ratio of a peak strength YAL(420) of the (420) plane of said perovskite phase to a peak strength YAG(420) of the (420) plane of said garnet phase, said peak strengths being measured by X-ray diffraction method.

* * * * *

UNITED STATES PATENT AND TRADEMARK OFFICE

CERTIFICATE OF CORRECTION

PATENT NO. : 7,138,192 B2
APPLICATION NO. : 10/633906
DATED : November 21, 2006
INVENTOR(S) : Hirotake Yamada and Tsuneaki Ohashi It is certified that error appears in the above-identified patent and that said Letters Patent is hereby corrected as shown below:

Title Page, Item (75)

*References cited, U.S. PATENT DOCUMENTS:* please add --2004/0224125 11/2004 Yamada et al.-- and
--2005/0019553 1/2005 Yamada--

Column 18

*Line 37:* please change "an" to --on--
*Line 38:* please add --a-- before "50"
*Line 41:* please delete "said"

Signed and Sealed this

Sixth Day of February, 2007

JON W. DUDAS
*Director of the United States Patent and Trademark Office*